US006039589A

United States Patent [19]

LaLange et al.

[11] Patent Number: 6,039,589

[45] Date of Patent: Mar. 21, 2000

[54] ELECTRICAL CONNECTOR WITH A SHUNT INCORPORATED INTO A SECONDARY LOCKING MEMBER

[75] Inventors: Jacques LaLange, Pontoise; Olivier Pamart, Ecouen, both of France

[73] Assignee: The Whitaker Corporation, Wilmington, Del.

[21] Appl. No.: 08/941,559

[22] Filed: Sep. 30, 1997

[51] Int. Cl.[7] ..... H01R 29/00

[52] U.S. Cl. ..... 439/188

[58] Field of Search ..... 439/188, 752, 439/596; 200/51.1

[56] References Cited

U.S. PATENT DOCUMENTS

| | | | |
|---|---|---|---|
| 4,070,557 | 1/1978 | Ostapovitch | 200/51.1 |
| 4,850,888 | 7/1989 | Denlinger et al. | 439/188 |
| 4,978,311 | 12/1990 | Oda et al. | 439/188 |
| 5,071,362 | 12/1991 | Martens | 439/188 |
| 5,651,693 | 7/1997 | Fukuda | 439/188 |

*Primary Examiner*—Steven L. Stephan
*Assistant Examiner*—Javaid Nasri

[57] ABSTRACT

An electrical connector comprises a shunt attached to a pivotable secondary locking member, for example by overmoulding. The shunt contact protrusions are positioned further towards the terminal receiving end of the connector than the pivot axis such that upon pivoting the secondary locking member from the preassembly to the fully locked position the contact force between the shunt and tab is increased.

10 Claims, 3 Drawing Sheets

ELECTRICAL CONNECTOR WITH A SHUNT INCORPORATED INTO A SECONDARY LOCKING MEMBER

BACKGROUND OF THE INVENTION

1. Field of the Invention

This invention relates to an electrical connector with a short circuit shunt.

2. Description of the Prior Art

In applications such as automotive airbags or seatbelt pretensioners, it is typical to provide electrical connectors with shunting contacts that short circuit conductors when connectors are uncoupled to prevent accidental ignition. Typically, short circuiting is performed by a separate spring contact comprising two or more resilient cantilever beam contact arms interconnecting adjacent terminals of the connector. These contacts require a separate cavity and retention means in a connector housing, thereby increasing the volume and cost of the assembly. Furthermore, insertion of terminals into their connector cavities is more difficult due to the presence of the shunt contacts that bias against the terminal, whereby a certain spring force is required to ensure reliable operation.

It is also typical to provide electrical connectors for the applications mentioned above, with secondary locking means for securely retaining terminals in the connector housing cavities. The secondary locking means are usually only engageable once the terminals are fully inserted into the cavities and locked with the primary locking means.

SUMMARY OF THE INVENTION

It is an object of this invention to provide an improved electrical connector with shunting contacts. In particular, a reliable shunted electrical connector is desired. Ease of assembly of the connector would be advantageous.

Objects of this invention have been achieved by providing the connector according to claim 1. In particular, an electrical connector is provided comprising a housing having terminal receiving cavities extending therethrough from a terminal receiving end to a mating end, and terminals comprising a connection section, contact section for mating with a complementary terminal of a complementary connector, and secondary locking shoulder, the connector further comprising a secondary locking member supported to the housing and comprising a locking member engageable with the terminal secondary locking shoulder for retaining the terminal in the cavity, wherein the connector further comprises a shunt contact for short circuit bridging two or more of the terminals of the connector, the shunt contact being attached to the secondary locking member.

Advantageously, a reliable shunted electrical connector is provided where controlled and effective shunt contact pressure is enabled. Attachment of the shunt contact to the secondary locking member provides a compact embodiment with less parts.

The secondary locking member may advantageously be pivot mounted about a pivot axis to the connector housing. Arrangement of the shunt contact point further from the connector mating end than the pivot axis enables increasing the shunt spring contact pressure upon engagement of the secondary locking member.

Further objects and advantageous aspects of this invention will be apparent from the following description, drawings and claims.

DETAILED DESCRIPTION OF THE PREFERRED EMBODIMENT

Figure 1:
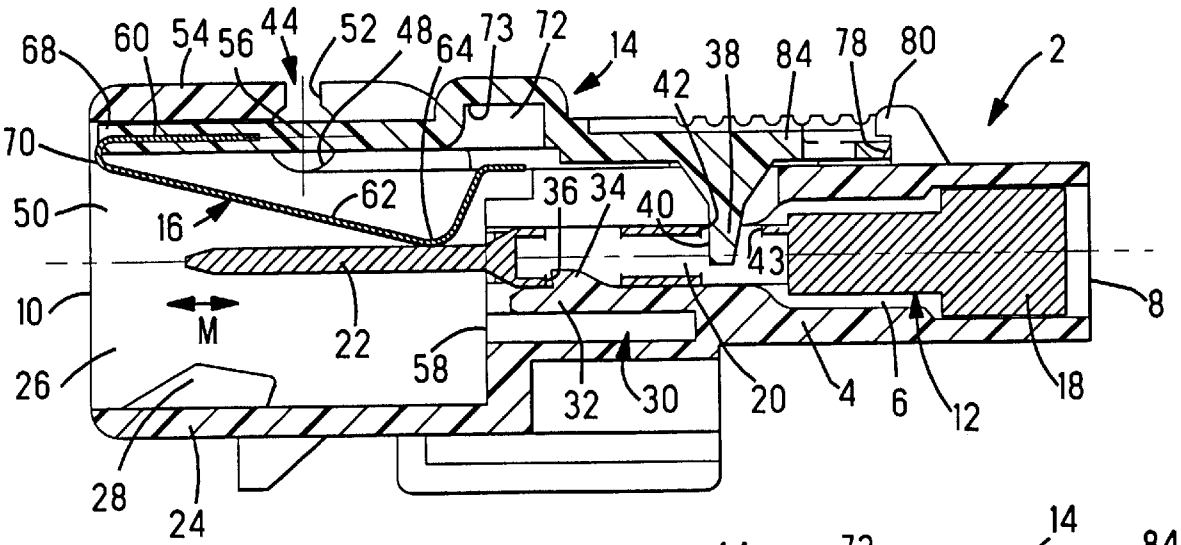
FIG. 1 is a cross-sectional view through a connector according this invention.

Referring to the figures, particularly FIG. 1, an electrical connector 2 comprises an insulative housing 4 having terminal receiving cavities 6 extending therethrough from a terminal receiving end 8 to a mating end 10 for receiving terminals 12. The connector 2 further comprises a secondary locking member 14 and a shunt 16. The electrical terminal 12 comprises a connection portion 18 for connection to a conductor such as a conducting wire, a body portion 20, and a contact portion 22 which is in the form of a tab or pin in this embodiment. The housing 4 comprises a shroud 24 defining a mating connector receiving cavity 26 within which the tab 22 is positioned. A latch protrusion 28 is provided in the cavity 26 for engaging a corresponding latching member of the mating connector (not shown) for latching the connectors together.

The terminal 12 is retained in the housing 4 by primary locking means 30 comprising a resilient cantilever beam locking lance 32 integral with the housing and having a locking protrusion 34 engaging in a cutout 36 in the body portion of the terminal. Other conventional primary locking means could be considered such as provision of a resilient lance extending from the contact engaging behind a shoulder of the housing.

The secondary locking member 14 comprises a locking protrusion 38 having a locking shoulder 40 that engages behind a locking shoulder 42 of the terminal 12 for providing a second robust means of retaining the terminal within the cavity. In this embodiment, the secondary locking protrusion 38 extends through a cutout 43 of the terminal from which the shoulder 42 results.

The secondary locking member 14 comprises a roughly planar base wall 45 extending from an engagement end 84 to a mating end 68 in the mating direction (M) positioned along a top wall 54 of the connector housing. The secondary locking member further comprises a pivot support 44 in the form of lateral extensions 46 extending from the base wall in a region proximate the mating end 68 and received in a housing bearing 48 in the form of a circular cutout in the sidewalls 50 of the shroud section 24. An opening 52 of the bearing 48 towards the top wall 54 is provided to enable assembly of the extensions thereinto. The pivot support 44 enables rotation of the secondary locking member 14 about a pivot axis 56 that is positioned, with respect to the mating direction M of the connector, between the mating end 10 and end face 58 within the shroud 24 through which the terminal contact sections 22 project.

The shunt 16 comprises a plurality of stamped and formed electrical contacts comprising an attachment portion 60, spring arms 62, contact protrusions 64 and free ends 66. The resilient contact arms are in the form of cantilever beams extending from the attachment portion to the free end. The attachment portion 60 is securely fixed to a mating end 68 of the secondary locking member, and in this embodiment secure attachment is affected by overmoulding the shunt attachment portion 60 with the insulative plastic of the secondary locking member. The spring arm 62 is reversely folded into the cavity area 26 from the attachment portion 60 through a U-bend 70. The free end 66 is in the form of a plateau to perform the function of an anti-overstress feature. The free end 66 is received within a recess 72 formed in the secondary locking member to enable biasing of the shunt spring arms 62 towards the top wall 54, which occurs during coupling with a complementary connector having an insulative projection that disengages the shunt contact protrusion 64 from the terminal contact portion 22. The shunt free end 66 abuts the base wall 73 of the recess 72 whilst the shunt spring arm 62 is still in the elastic range, thereby preventing plastic deformation thereof.

Secure attachment of the shunt to the secondary locking member enables a particularly compact shunt function to be achieved, and ensures secure and precise positioning of the shunt within the housing. Furthermore, assembly of the shunt to the housing is ensured—the lack of shunt being evident due to the lack of secondary locking member which is easily detected.

Figure 2:
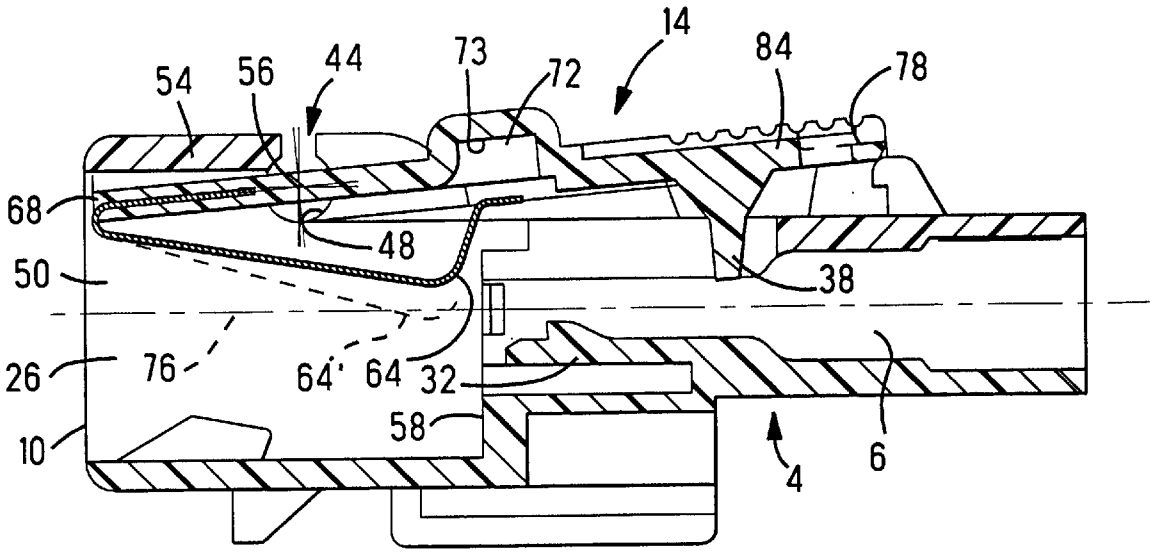
FIG. 2 is a cross-sectional view through the connector of FIG. 1 prior to mounting of terminals therein.
Figure 3:
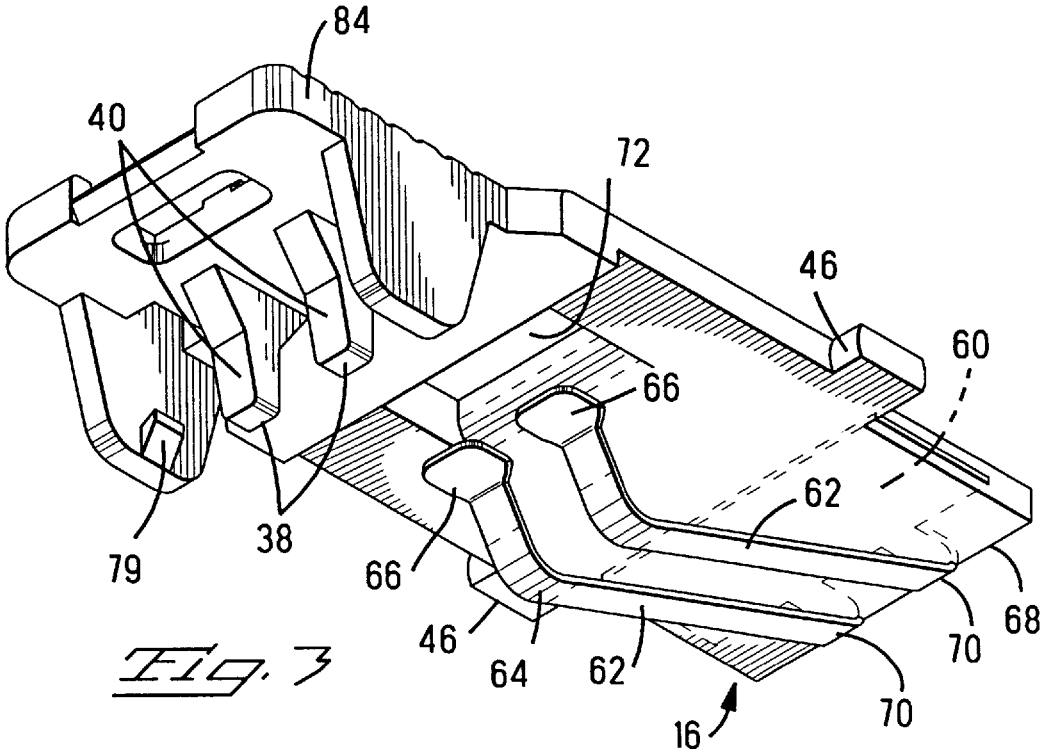
FIG. 3 is an isometric view of a secondary locking and shunting member.
Figure 4:
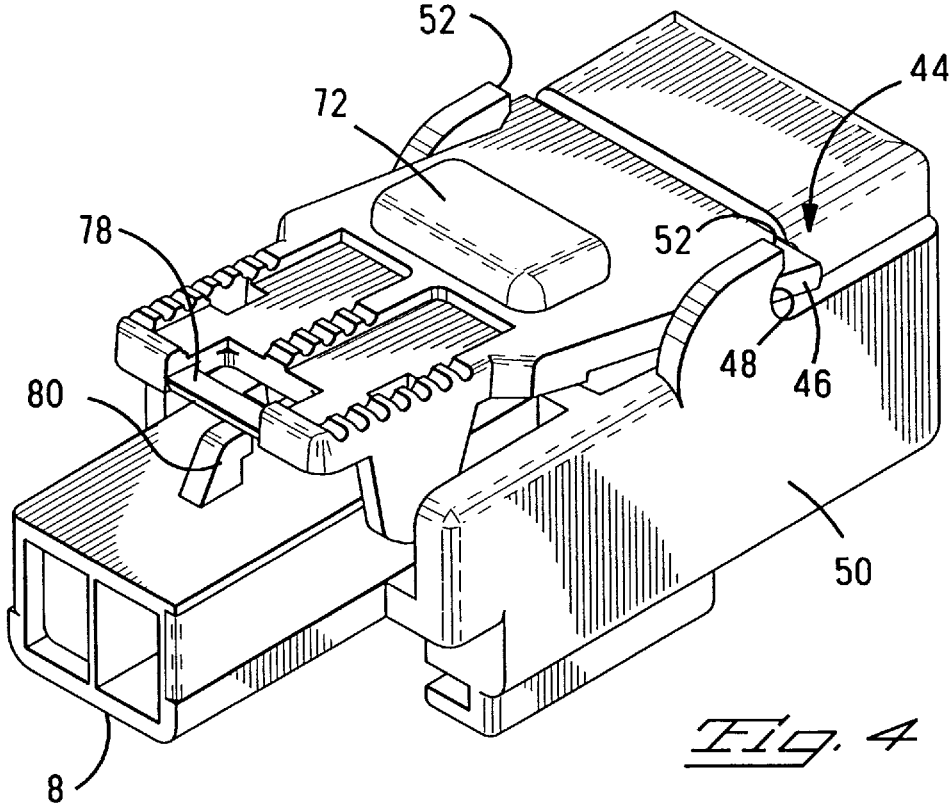
FIGS. 4 and 5 are isometric views of the connector in the pre-assembly and fully locked positioned respectively.
Figure 5:
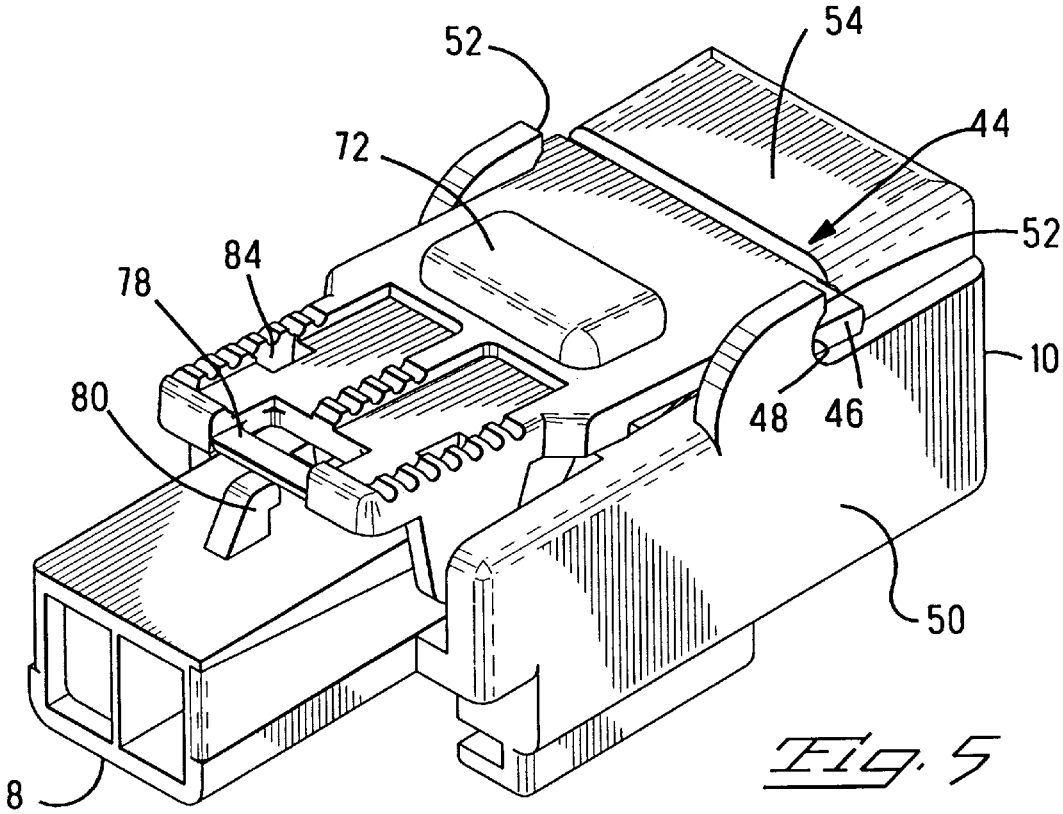
Figure 6:
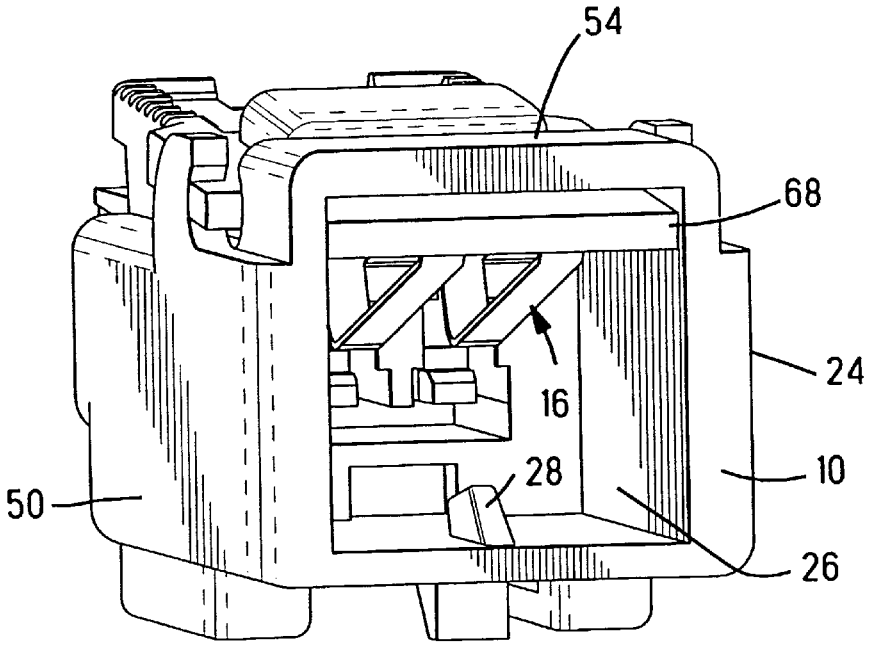
FIG. 6 is an isometric view towards the mating face of the connector.

The shunt contact protrusion 64 is positioned in the mating direction M further towards the terminal receiving end 8 than the pivot axis 56. Referring particularly to FIG. 2, the secondary locking member is shown in the preassembly position whereby terminals 12 can be received within the cavities 6, i.e. the secondary locking protrusion 38 does not obstruct the cavity 6. In view of the position of the contact protrusion with respect to the pivot axis 56, the contact protrusion 64 is positioned closer to a central axis 76 along which the tab 22 extends, than in the fully locked position where the shunt would be positioned at 64' further from the axis 76. The fully locked position is defined by the position of the secondary locking member as shown in FIG. 1. During insertion of the terminal 12 into the cavity 6, the spring force of the contact protrusion 64 against the tab 22 is thereby reduced, the shunt spring contact force being increased by pivoting of the secondary locking member from the preassembly to the fully locked position. A high shunt contact force can thus be achieved.

In the preassembly position as shown in FIG. 2, mating of the connector with a complementary connector is prevented by the position of the secondary locking member mating end 68 within the cavity area 26, thereby obstructing entry of a mating connector. In the fully locked position as shown in FIG. 1, the mating end 68 is biased against the shroud top wall 54 removing obstruction into the shroud cavity 26. The secondary locking member is held in the fully locked position by latching members 78,79 that engage complementary latching members 80 of the housing arranged proximate a terminal receiving end 82 of the secondary locking member. The secondary locking member locking protrusion 38 is positioned proximate an engagement end 84 of the secondary locking member disposed proximate the terminal receiving end 8 of the connector. Simple depression on the engagement 84 pivots the secondary locking member to the fully locked position if the terminals are fully inserted. A partially inserted terminal prevents engagement of the secondary locking member by abutment of the protrusion 38 on the body (or contact portion) of the terminal, thereby preventing coupling with a mating connector due to the position of the secondary locking member mating end 68 in the shroud cavity 26.

I/we claim:

1. An electrical connector comprising a housing having terminal receiving cavities extending therethrough from a terminal receiving end to a mating end, and terminals comprising a connection section, contact section for mating with a complementary terminal of a complementary connector, and secondary locking shoulder, and primary retention means acting between the housing and the terminal to retain the terminal within the cavity, the connector further comprising a secondary locking member supported at a support to the housing and comprising a locking protrusion engageable behind the terminal secondary locking shoulder for retaining the terminal in the cavity characterized in that the connector further comprises a shunt contact for short circuit bridging two or more of the terminals of the connector, the shunt contact being attached to the secondary locking member.

2. The connector of claim 1 wherein the support is a pivot support.

3. The connector of claim 2 wherein the secondary locking member pivots about a divot axis of the pivot support disposed closer to the mating end of the connector where the complementary connector is received, than contact protrusions of the shunt that engage the terminals.

4. The connector of claim 3 wherein the pivot support comprises lateral extensions received in substantially circular bearings.

5. The connector of claim 1 wherein the shunt comprises cantilever beam spring arms extending between an attachment portion and contact protrusions for contacting the terminals.

6. The connector of claim 5 wherein the attachment portion is secured to the secondary locking member proximate a mating end thereof.

7. The connector of claim 5 wherein the secondary locking member includes a mating end portion located towards the mating end of the connector housing that is positioned within a cavity of the connector housing defined by a shroud receiving the complementary connector therein.

8. The connector of claim 1 wherein the shunt is attached to the secondary locking member by overmoulding an attachment portion of the shunt.

9. The connector of claim 1 wherein the shunt comprises an anti-overstress member for engaging the secondary locking member to prevent over deformation thereof.

10. The connector of claim 9 wherein the anti-overstress member is at a free end of a contact spring arm of the shunt, the free end being received in a recess in the secondary locking member to enable greater travel of shunt spring arms.

* * * * *